US010759630B2

(12) United States Patent
Sigmon et al.

(10) Patent No.: US 10,759,630 B2
(45) Date of Patent: Sep. 1, 2020

(54) TOOL FOR CABLE WINDING MACHINE AND METHODS

(71) Applicant: COMMSCOPE, INC. OF NORTH CAROLINA, Hickory, NC (US)

(72) Inventors: David E. Sigmon, Newton, NC (US); Ricky Rathbone, Catawba, NC (US); Andrew C. Robinson, Denver, CO (US)

(73) Assignee: COMMSCOPE, INC. OF NORTH CAROLINA, Hickory, NC (US)

( * ) Notice: Subject to any disclaimer, the term of this patent is extended or adjusted under 35 U.S.C. 154(b) by 0 days.

(21) Appl. No.: 16/306,852

(22) PCT Filed: Jun. 2, 2017

(86) PCT No.: PCT/US2017/035708
§ 371 (c)(1),
(2) Date: Dec. 3, 2018

(87) PCT Pub. No.: WO2017/210572
PCT Pub. Date: Dec. 7, 2017

(65) Prior Publication Data

US 2019/0144237 A1 May 16, 2019

Related U.S. Application Data

(60) Provisional application No. 62/345,333, filed on Jun. 3, 2016.

(51) Int. Cl.
*B65H 75/28* (2006.01)

(52) U.S. Cl.
CPC ..... *B65H 75/28* (2013.01); *B65H 2701/341* (2013.01)

(58) Field of Classification Search
CPC .. B65H 65/00; B65H 75/28; B65H 2701/341; B65H 2701/36
See application file for complete search history.

(56) References Cited

U.S. PATENT DOCUMENTS 4,034,933 A 7/1977 Hara et al.
2005/0242227 A1 11/2005 Takeda et al.

FOREIGN PATENT DOCUMENTS

JP H08-165061 A 6/1996
JP H11-21018 A 1/1999
JP 2001-354362 A 12/2001

OTHER PUBLICATIONS

Machine Translation of JP H08 165061, dated Jun. 25, 1996. (Year: 1996).*
International Search Report and Written Opinion of the International Searching Authority for International Patent Application No. PCT/US2017/035708 dated Aug. 25, 2017, 14 pages.

* cited by examiner

*Primary Examiner* — William E Dondero
(74) *Attorney, Agent, or Firm* — Merchant & Gould P.C.

(57) ABSTRACT

A tool for a cable winding machine includes a plate and at least one clamp assembly mounted to the plate. The clamp assembly includes a clamp pad movable toward and away from the plate between a clamped position and a released position. A shaft is secured to the center of the plate. The tool can be part of a cable winding machine that secures to a spool. The end of the cable can be releasably clamped between the clamp pad and the plate.

34 Claims, 12 Drawing Sheets

TOOL FOR CABLE WINDING MACHINE AND METHODS

CROSS-REFERENCE TO RELATED APPLICATION

This application is a National Stage of PCT/US2017/035708, filed on Jun. 2, 2017, which claims the benefit of U.S. Patent Application Ser. No. 62/345,333, filed on Jun. 3, 2016, the disclosures of which are incorporated herein by reference in their entireties. To the extent appropriate, a claim of priority is made to each of the above disclosed applications.

TECHNICAL FIELD

This disclosure relates to a tool for use with a cable winding machine. In particular, this disclosure relates to a tool that will releasably secure the end of a cable for the winding process.

BACKGROUND

In cable manufacturing, typically a reel is loaded onto a take-up or spool and used to wind cable of various lengths. These reels usually have a starting hole, or opening, through one or both flanges in which the cable is inserted. The beginning (bottom end) of the cable is then attached to the outside of the flange using a nail, or other fastener, to keep the cable from pulling through the flange during spooling. When the cable is unspooled from the reel, the bottom end must be freed from its attachment to the reel flange.

During cable production, there are often several processes a cable must go through before the cable reaches its final construction. The number of processes a cable must go through to reach final construction may vary, from as few as one process, to what could be many. At each stage of construction, the cable is unspooled from the reel, run through the process, and spooled back onto another reel. The cable must be attached in some form to the reel during each processing stage.

The repeated attaching and un-attaching of the cable to the reel flange is labor intensive, time consuming, and results in damage to the reel flange and/or the cable. Improvements are desirable.

SUMMARY

This disclosure solves problems of the prior art. In general, this disclosure relates to a tool for a cable winding machine that is easy to use, less labor intensive, and does not result in damage to the reels or cables. As such, the disclosure addresses and solves the problems of the prior art.

In accordance with principles of this disclosure, a tool for a cable winding machine is provided. The tool includes a plate, at least one clamp assembly mounted to the plate, and a shaft secured to the center of the plate. The at least one clamp assembly includes a clamp pad that is movable toward and away from the plate between a clamped position and a released position.

The at least one clamp assembly preferably is power driven.

The at least one clamp assembly can be one of pneumatically driven or hydraulically driven.

In some embodiments, the shaft includes a fluid passageway in communication with the at least one clamp assembly. The at least one clamp assembly includes a fluid driven cylinder responsive to the fluid passageway in the shaft to move the clamp pad from the released position to the clamped position.

In one or more embodiments, the at least one clamp assembly is pneumatically driven and includes cylinder head and a spring. The clamp pad is secured to the air cylinder head. The air cylinder head is retractable against the spring responsive to air pressure in the fluid passageway of the shaft to move the clamp pad in a direction toward the plate.

In some embodiments, the at least one clamp assembly includes a plurality of clamp assemblies mounted to the plate.

For some implementations, the plate is circular, and the plurality of clamp assemblies are mounted along a circumference of the plate and are circumferentially spaced from each other. Each of the clamp assemblies is operably controlling a section of the clamp pad.

In some implementations, each of the clamp assemblies in the plurality of clamp assemblies is pneumatically driven, and each includes an air cylinder head and a spring. The clamp pad section is secured to each respective air cylinder head. Each air cylinder head is retractable against the respective spring responsive to air pressure in the fluid passageway of the shaft to move the clamp pad section in a direction toward the plate.

In some examples, each of the clamp assemblies comprises an inner disk secured to the outer disk, the inner disk having an outside perimeter with plurality of outward projections.

In some embodiments, the outside perimeter of the inner disk has a sawtooth shape, and wherein the outside perimeter of the inner disk is in axial overlap with the clamp pad section.

There may be a clamp guard section covering an outer rim of the outer disk and an outer rim of the clamp pad section, in some arrangements.

In one or more embodiments, each of the clamp assemblies has at least two air cylinder heads and spring, spaced apart from each other and secured to the outer disk.

In some examples, each of the clamp assemblies further includes at least one linear bearing secured to the outer disk.

In some examples, each of the clamp assemblies further includes two linear bearings mounted between the two air cylinder heads.

In another aspect, a spool assembly for holding a length of cable is provided. The spool assembly includes a winding cylinder. A pair of flanges each having an interior surface and an exterior surface are secured to the winding cylinder spaced from and with respective interior surfaces being in opposing relation to each other. A region of the winding cylinder is between the opposing flanges and forms a winding region. At least a first of the flanges includes a through-slot sized to allow cable to pass through the first flange from the winding region. A tool is operably connected to the first flange. The tool includes a plate and at least one clamp assembly mounted to the plate. At least one clamp assembly is positioned to receive the cable from the through-slot in the first flange, when a cable is mounted thereon.

In some embodiments, the clamp assembly includes a clamp pad movable toward and away from the plate between a clamped position and a released position.

In some embodiments, the tool includes a shaft secured to a center of the plate.

In some embodiments, the tool comprises the tool that is variously characterized above.

The spool assembly can further include cable wound around the winding cylinder and having an end extending through the through-slot and held by the clamp assembly.

In another aspect, a winding machine for winding a length of cable onto a spool assembly is provided. The winding machine includes a frame constructed and arranged for removably holding a spool assembly. A tool, as variously characterized above, is secured to the frame.

The winding machine can further include a spool assembly mounted to the frame, in which the spool assembly includes a winding cylinder and pair of flanges. Each of the flanges has an interior surface and an exterior surface. The flanges are secured to the winding cylinder spaced from and with respective interior surfaces in opposing relation to each other. A region of the winding cylinder between the opposing flanges forms a winding region. At least a first of the flanges includes a through-slot sized to allow cable to pass through the first flange from the winding region. The first flange is operably connected to the tool. The at least one clamp assembly is positioned to receive the cable from the through-slot in the first flange when a cable is mounted thereon.

The winding machine may further include a cable wound around the winding cylinder and having an end extending through the through-slot and held by the clamp assembly.

In another aspect, a method of winding a length of cable onto a spool is provided. The method includes orienting an end of a cable through a through-slot in a flange of a spool. The method includes using a tool and engaging a clamp assembly secured to the spool to releasably fix the cable to the tool for winding the cable about the spool.

The step of engaging a clamp assembly can include driving a clamp pad toward a plate of the tool connected to the spool.

The step of driving a clamp pad can include pneumatically driving the clamp pad through a fluid passageway in a central shaft secured to the plate.

The step of pneumatically driving the clamp pad can include driving a cylinder responsive to the fluid passageway in the shaft to move the clamp pad to squeeze the cable between the clamp pad and the plate.

The step of engaging a clamp assembly can include engaging a plurality of clamp assemblies circumferentially spaced about the flange of the spool.

The step of engaging the plurality of clamp assemblies can include simultaneously engaging all of the clamp assemblies to move a respective section of the clamp pad.

The method can further include winding the cable about the spool and then disengaging the clamp assembly to release the cable from the tool.

The step of winding the cable may include using a winding machine to rotate the spool, and after the step of disengaging the clamp assembly, removing the spool from the winding machine and the tool.

In another aspect, a clamp assembly for use with a tool for a cable winding machine is provided. The clamp assembly can include an outer disk including a connection arrangement to allow connection and removal of the clamp assembly from a tool for a cable winding machine; at least one cylinder arrangement secured to the outer disk; and a clamp pad section operably secured to the cylinder arrangement and being movable toward and away from the outer disk between a clamped position and a released position.

The at least one cylinder arrangement can include a housing having interior, the housing have a fluid port to permit inflow and outflow from the interior; a piston rod having a portion within the housing interior and a portion outside of the housing interior; a cylinder head in the interior secured to the piston rod, the cylinder head positioned to receive fluid flow thereon from the fluid port to move the cylinder head and the piston rod linearly within the housing interior; and a projection secured to the portion of the piston outside of the housing interior, the projection being constructed and arranged to connect to the clamp pad section, the projection moving linearly with the piston rod and cylinder head to move the clamp pad section.

In some implementations, the clamp assembly further includes a spring in the housing interior biasing the cylinder head.

In some examples, the clamp assembly further includes an inner disk secured to the outer disk, the inner disk being located on a side of the outer disk opposite of the housing of the cylinder arrangement.

The inner disk can have an outside perimeter with plurality of outward projections.

In one or more examples, the clamp assembly further comprises a clamp guard section covering an outer rim of the outer disk and an outer rim of the clamp pad section.

In some embodiments, the clamp assembly includes two cylinder arrangements spaced apart from each other and secured to the outer disk.

In some arrangements, the clamp assembly can further comprise at least one linear bearing secured to the outer disk.

A variety of additional inventive aspects will be set forth in the description that follows. The inventive aspects can relate to individual features and to combinations of features. It is to be understood that both the forging general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein and constitute a part of the description, illustrate several aspects of the present disclosure. A brief description of the drawings is as follows.

DETAILED DESCRIPTION

The tool described herein can aid anyone using a cable wind-up take-up machine to wind cable onto a spool or reel. The tool allows for safe, reliable, and quick grasping of an end of the cable to hold the cable for the current process and then release the cable to allow the end to freely unwind from the reel during the next process. The tool as described herein replaces a means of attachment at each stage of the cable production.

In general, the tool in accordance with principles of this disclosure can be used by loading a spool onto a cable winding machine; inserting a cable through a starting hole in the spool until resistance is felt; actuating a clamp which will squeeze against the cable and secure the cable in place on the spool; and at the operator's discretion, releasing the clamp to release the end of the cable. The spool of cable may then be removed from the winding machine and taken to the next process or prepared for shipment to a customer.

Figure 1:
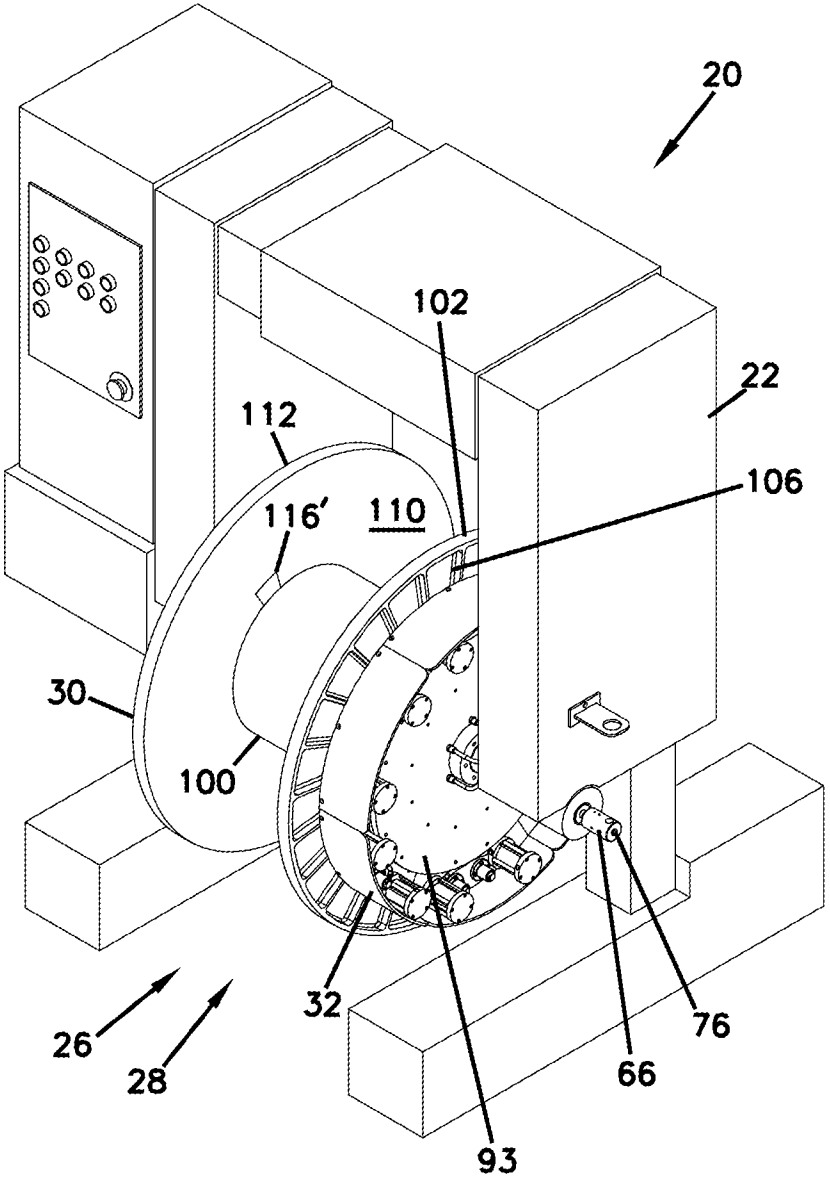
FIG. 1 is a perspective view of a winding machine for winding a length of cable onto a spool assembly, the spool assembly including a spool and a tool mounted to the spool, constructed in accordance with principles of this disclosure.
Figure 2:
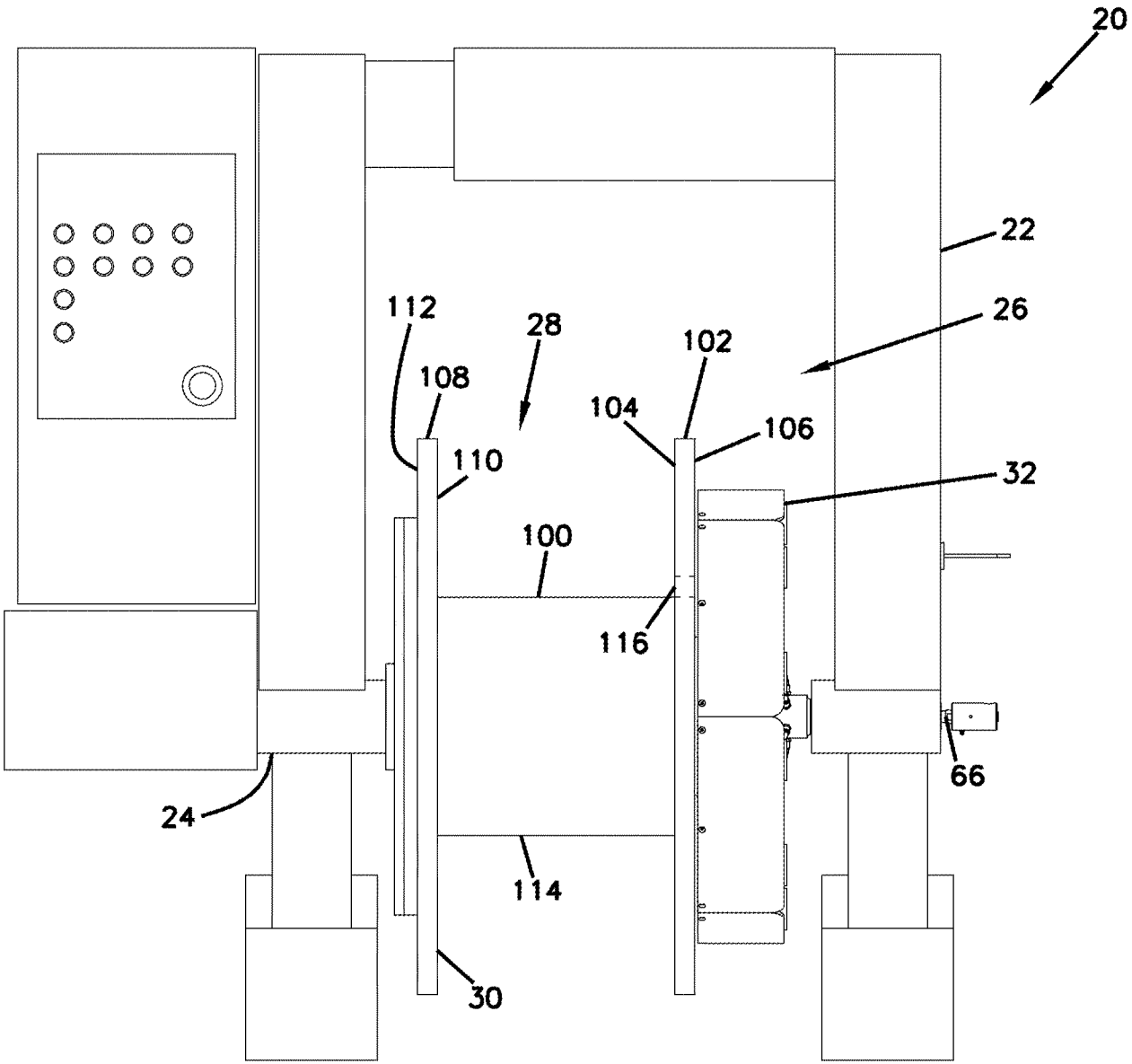
FIG. 2 is a front view of the cable winding machine of FIG. 1.

In reference now to FIG. 1, a take-up or cable winding machine is depicted at 20. The cable winding machine 20 includes a frame 22 controlling a spindle 24 (FIG. 2). The frame 22 defines a volume 26 for receiving a reel or spool assembly 28. The spool assembly 28 is removably mountable onto the frame 22 in the volume 26 such that the spindle 24 can rotate the spool assembly 28. The spool assembly 28 includes a reel or spool 30 with a tool 32 operably connected to the spool 30.

In general, cable is wound or unwound onto the spool 30 through rotation on the spindle 24 of the cable winding machine 20. A tool 32 generally remains attached to the cable winding machine 20, while the spool 30 is removable therefrom after winding or unwinding.

Figure 3:
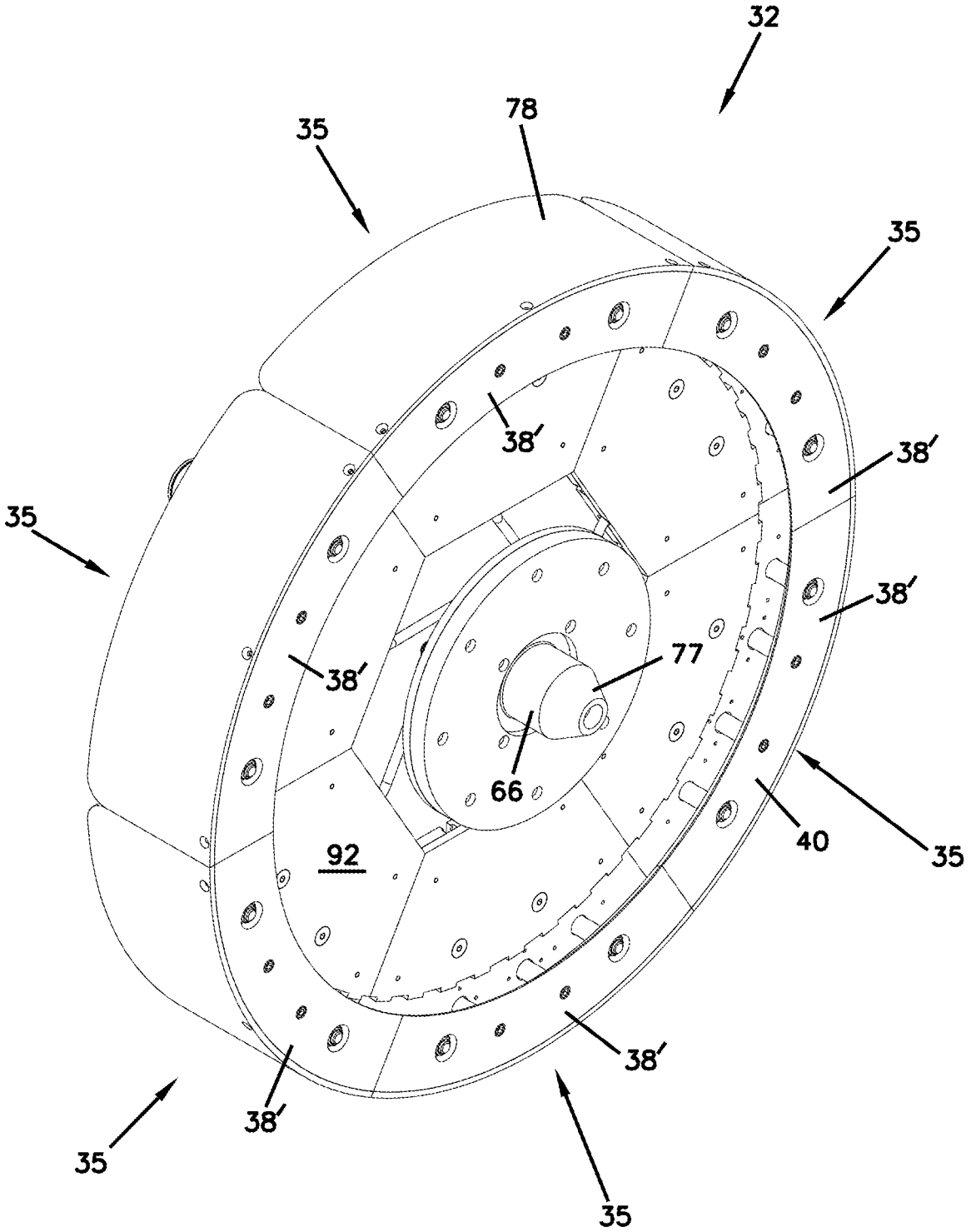
FIG. 3 is a perspective view of the tool isolated from the spool assembly and cable winding machine of FIG. 1.
Figure 4:
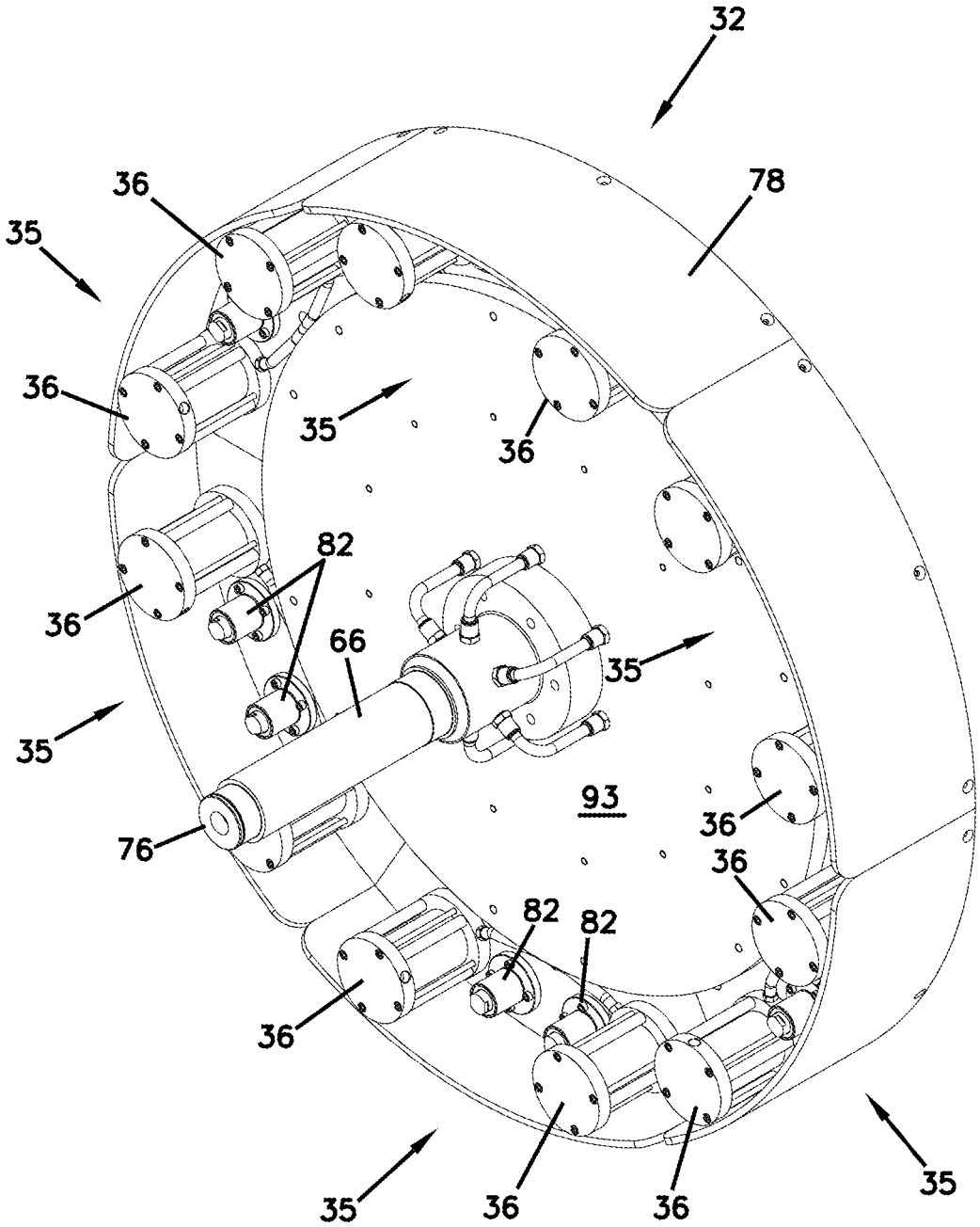
FIG. 4 is an opposite perspective view of the tool of FIG. 3, a plurality of clamp assemblies on the tool being viewable.
Figure 5:
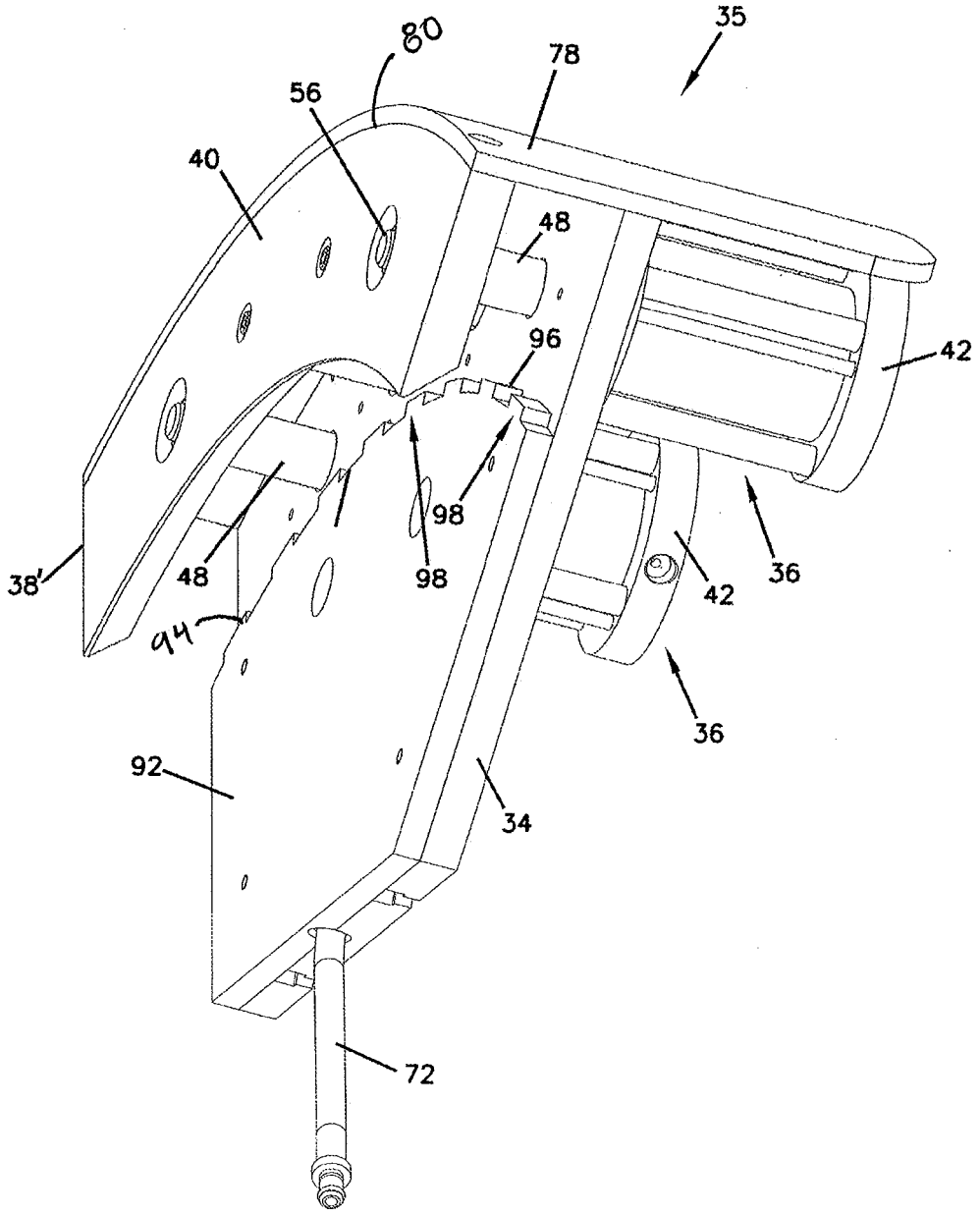
FIG. 5 is a perspective view of one of the clamp assemblies of FIG. 4.
Figure 6:
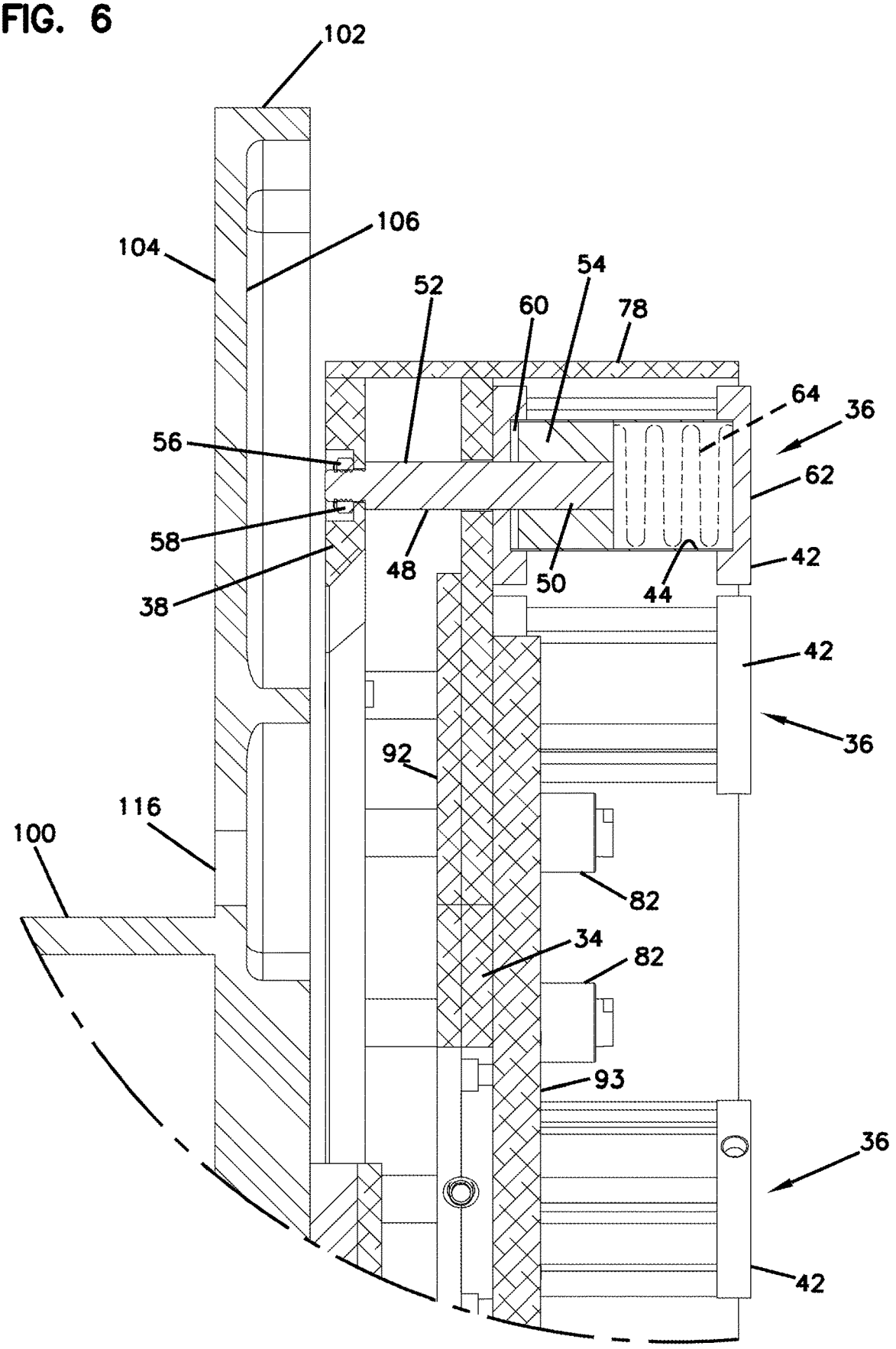
FIG. 6 is a cross-sectional view of a portion of the tool, the cross-section taken along line 6-6 of FIG. 11, and showing the cross-section of the tool attached to a portion of the spool, constructed in accordance with principles of this disclosure.
Figure 7:
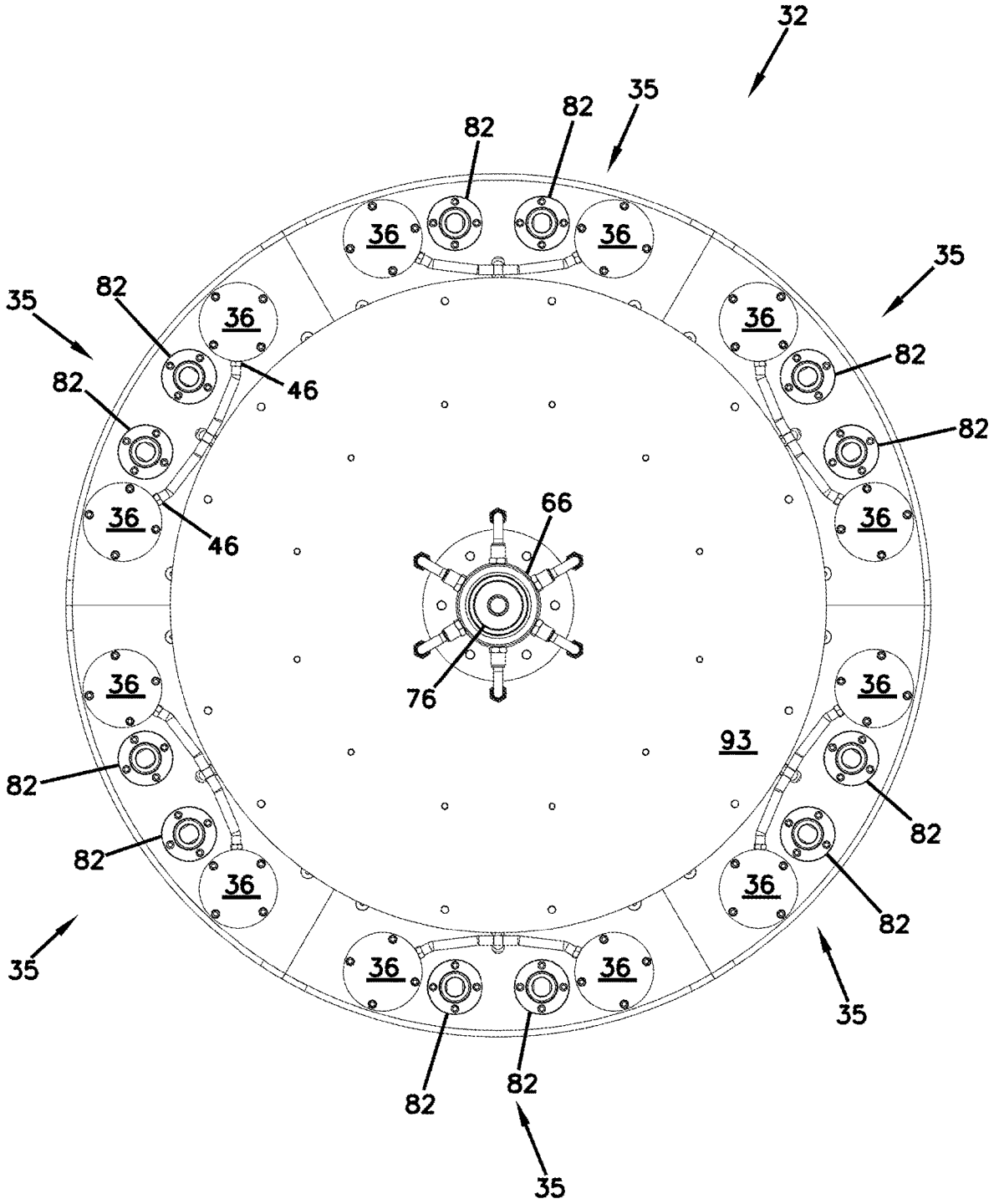
FIG. 7 is a front view of the tool depicted in FIG. 4, a plurality of the clamp assemblies of FIG. 5 being shown attached to a plate.
Figure 8:
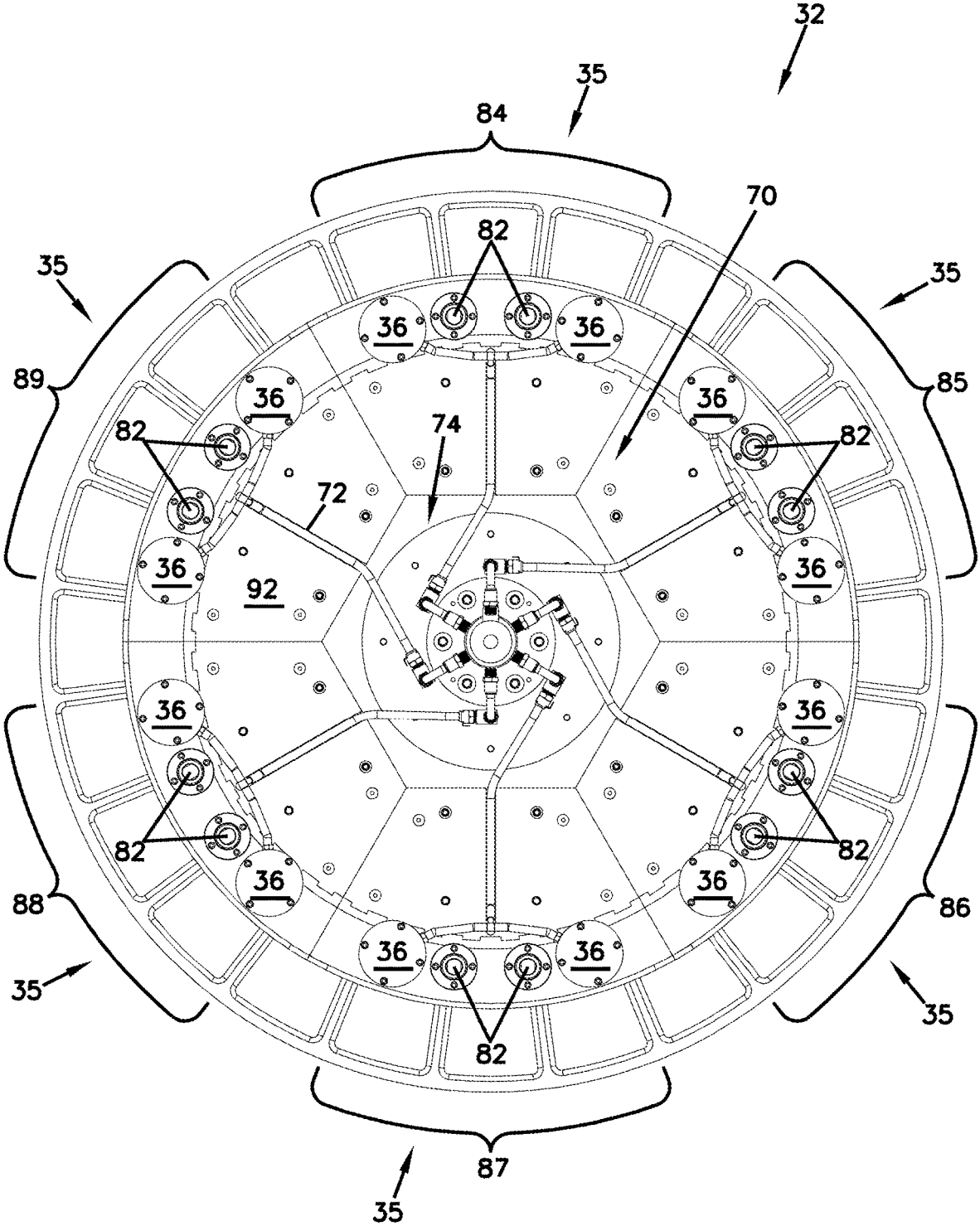
FIG. 8 is a front view of the tool depicted in FIGS. 4 and 7 with the plate removed to reveal internal components.
Figure 9:
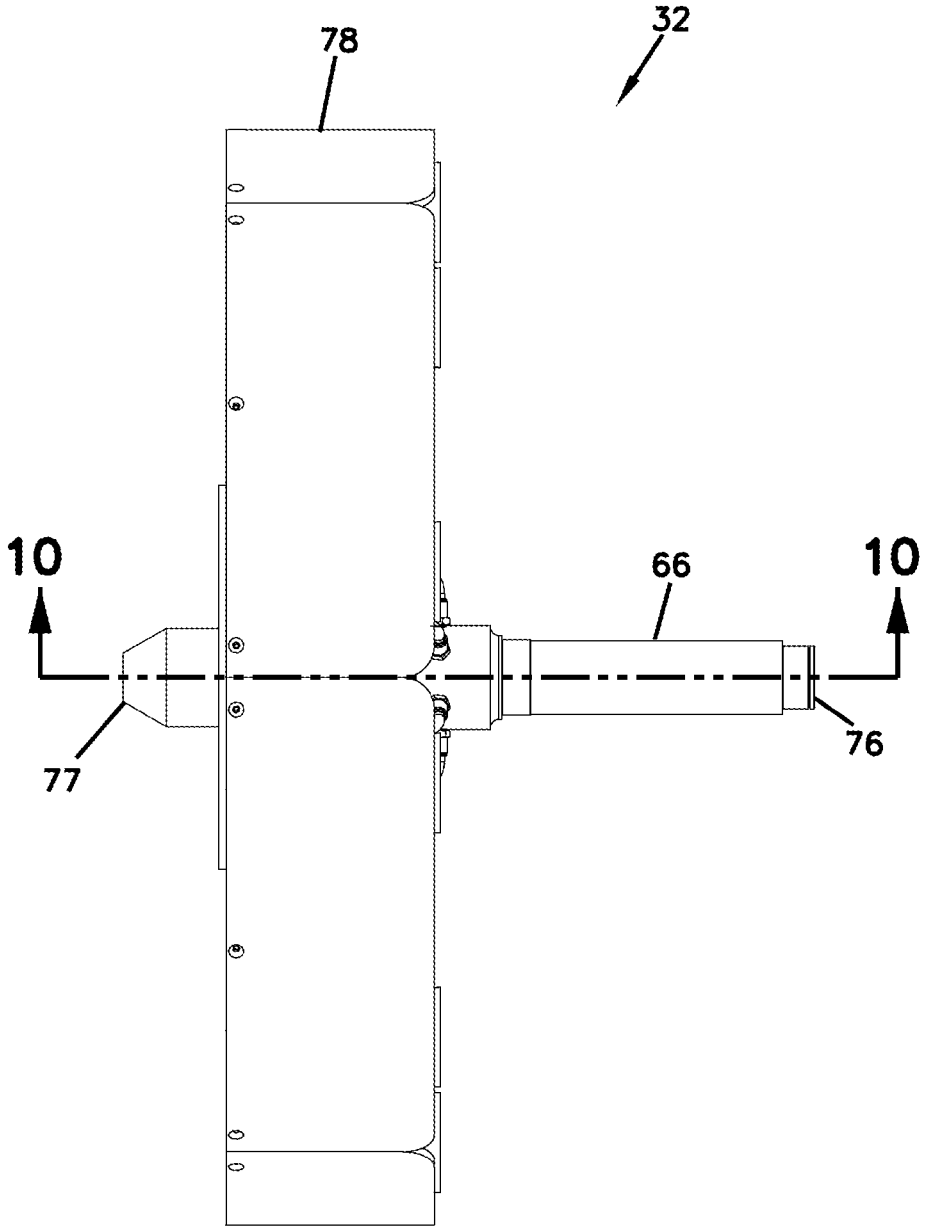
FIG. 9 is side view of the tool shown in FIGS. 3 and 4.

In reference now to FIGS. 3-8, the tool 32 includes a plate 93 (FIGS. 4, 6, and 8). Many embodiments are possible. In this embodiment, the plate 93 is generally circular.

In accordance with principles of this disclosure, the tool 32 includes at least one clamp assembly 35 (FIGS. 4, 5, 7, and 8). The at least one clamp assembly 35 is mounted to the plate 93. Many different ways to mount the clamp assembly 35 to the plate 93 are contemplated. For example, the clamp assembly 35 can include fasteners (e.g., screws) or connection structure or a connection arrangement to allow connection to and removal from the plate 93.

The at least one clamp assembly 35 includes a clamp pad 38 (FIGS. 3 and 5). The clamp pad 38 is movable toward and away from the plate 93 between a clamped position and a released position. As explained further below, when using a plurality of clamp assemblies 35, each clamp assembly 35 has a clamp pad section 38'. In FIGS. 3 and 5, it can be seen how, in preferred embodiments, all of the clamp pad sections 38' together form a circular band 40. The clamp pad 38 is radially spaced from the plate 93 when in the released position.

In accordance with principles of this disclosure, the at least one clamp assembly 35 is power-driven. Many embodiments are possible. For example, the clamp assembly 35 can be one of pneumatically driven or hydraulically driven. In the example embodiment illustrated, the at least one clamp assembly 35 is pneumatically driven.

Figure 12:
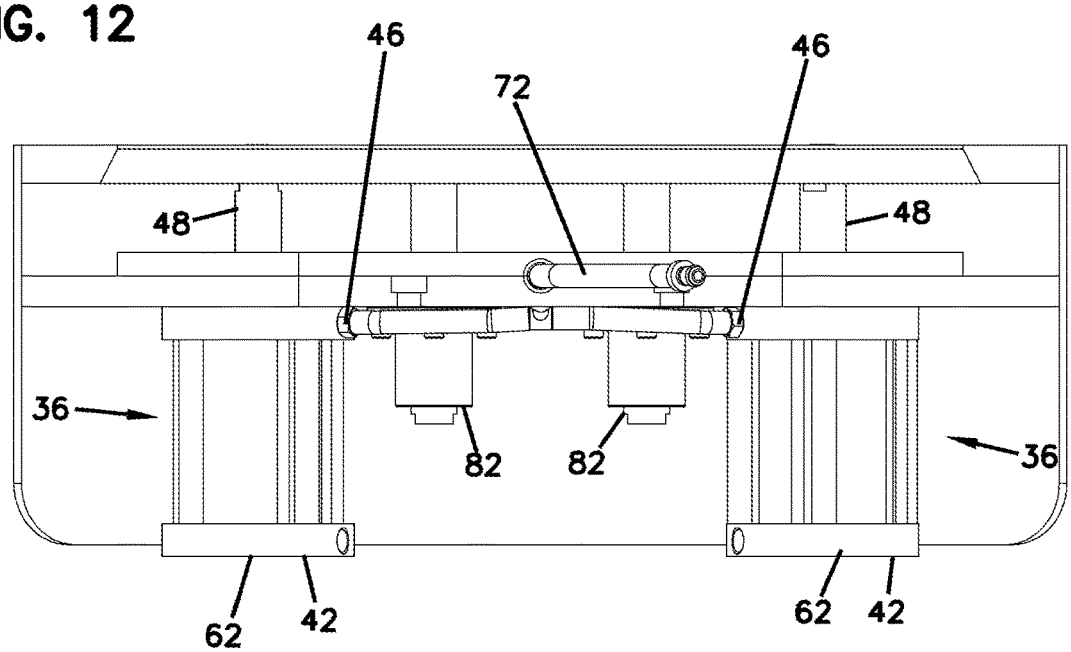
FIG. 12 is a top view of a portion the tool with a clamp guard removed to reveal internal components.

In reference now to FIGS. 5 and 6, one example embodiment of clamp assembly 35 is described. The clamp assembly 35 can include an air cylinder arrangement 36 having a housing 42 with an interior 44. The housing 42 is secured to an outer disk 34. The outer disk 34 can include a connection arrangement which may include fasteners (e.g., screws) securing the disk 34 to the plate 93. The housing 42 has a fluid port 46 (FIG. 12) to permit inflow and outflow fluid from the interior 44.

Still in reference to FIG. 6, the air cylinder arrangement 36 includes a piston rod 48. The piston rod 48 has a portion 50 within the housing interior 44 and a portion 52 outside of housing interior 44.

A cylinder head 54 is in the interior 44 and is secured to the piston rod 48. The cylinder head 54 is positioned to receive fluid flow thereon from the fluid port 46 to move the cylinder head 54 and the piston rod 48 linearly within the housing interior 44.

A projection 56 is secured to the portion 52 of the piston rod 48 that is outside of the housing interior 44. The projection 56 is constructed and arranged to connect to the clamp pad section 38'. The projection 56 moves linearly with the piston rod 48 and the cylinder head 54 to move the clamp pad section 38'. The projection 56 may be embodied in many forms. In the example embodiment, the projection 56 is a locknut 58.

From a review of FIG. 6, it can be seen how the piston rod 48 projects through an opening in the outer disk 34. When fluid, such as air, enters the port 46, it enters the volume 60 (FIG. 6) located between the cylinder head 54 and the housing 42. The fluid creates pressure, causing a force to push against the cylinder head 54 and move the cylinder 54 and the piston rod 48 in a direction toward a free end 62 of the housing 42.

The air cylinder arrangement 36 further includes a spring 64. The spring 64 is illustrated schematically in FIG. 6. The cylinder head 54 will act against the force of the spring 64. When the fluid pressure is released and removed from the housing 42, the spring 64 moves to the position shown in FIG. 6, with the cylinder head 54 located adjacent to the housing 42 secured to the outer disk 34.

In accordance with principles of this disclosure, the tool 32 includes a shaft 66. In the embodiments shown in FIGS. 3 and 4, the shaft 66 is secured to a center of the plate 93. The shaft 66 is usable for mounting the spool 30 to the tool 32, when loaded into the cable winding machine 20. The shaft 66 has opposite ends 76, 77. End 77 can be used to attach to or engage the spool 30 (FIGS. 1 and 2).

Figure 10:
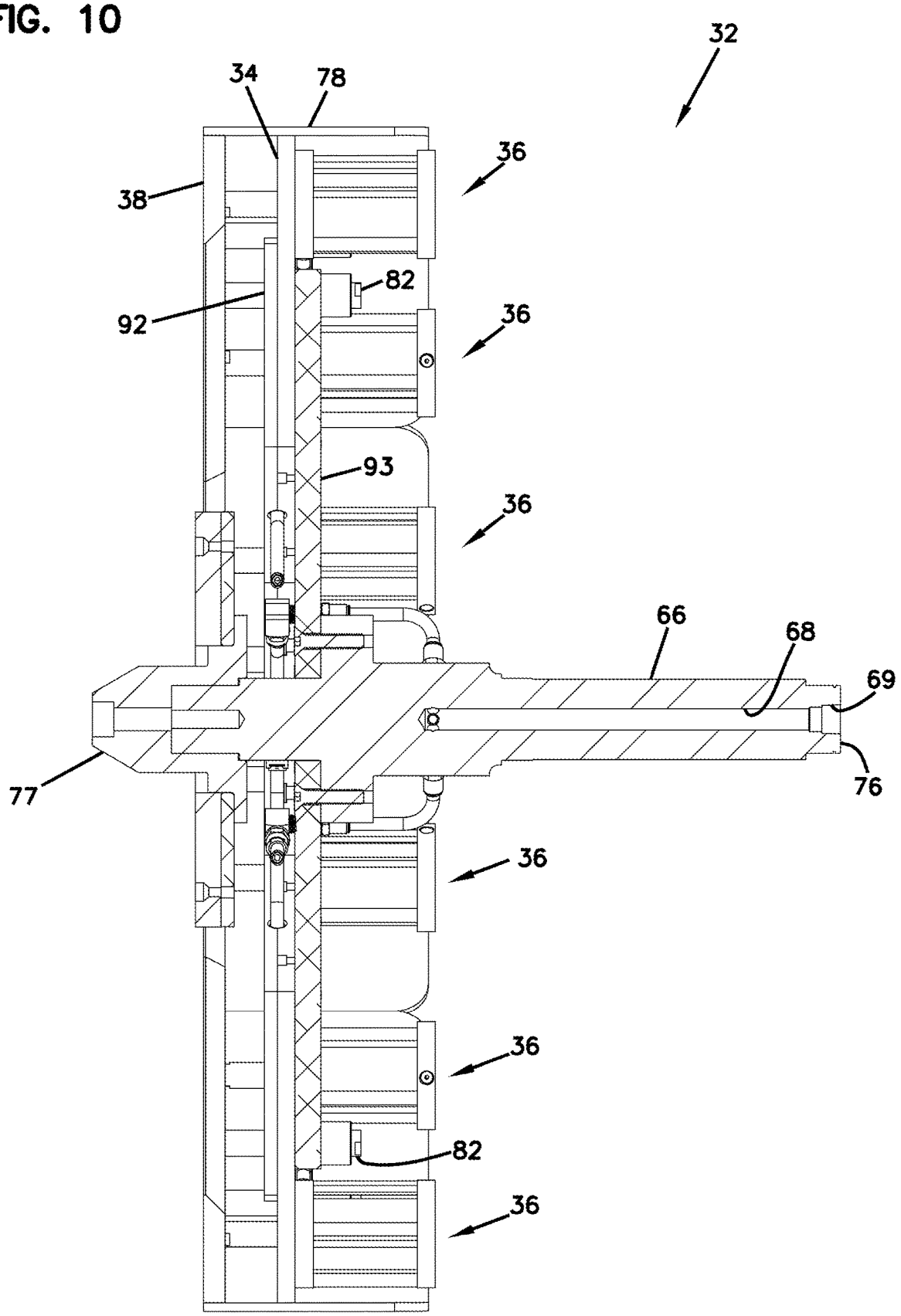
FIG. 10 is a cross-sectional view of the tool of FIG. 9, the cross-section being taken along the line 10-10 of FIG. 9.
Figure 11:
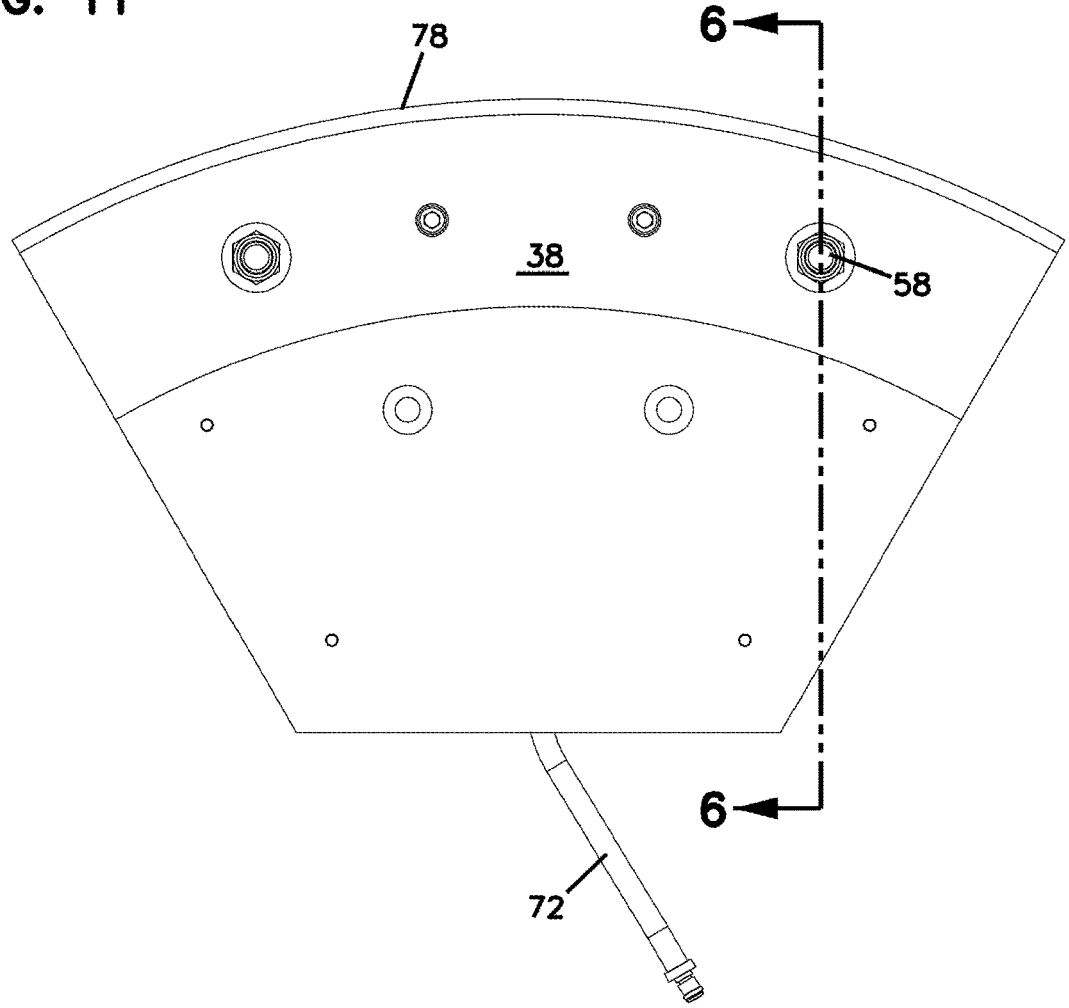
FIG. 11 is a front view of a portion of the tool of FIG. 3.
Figure 13:
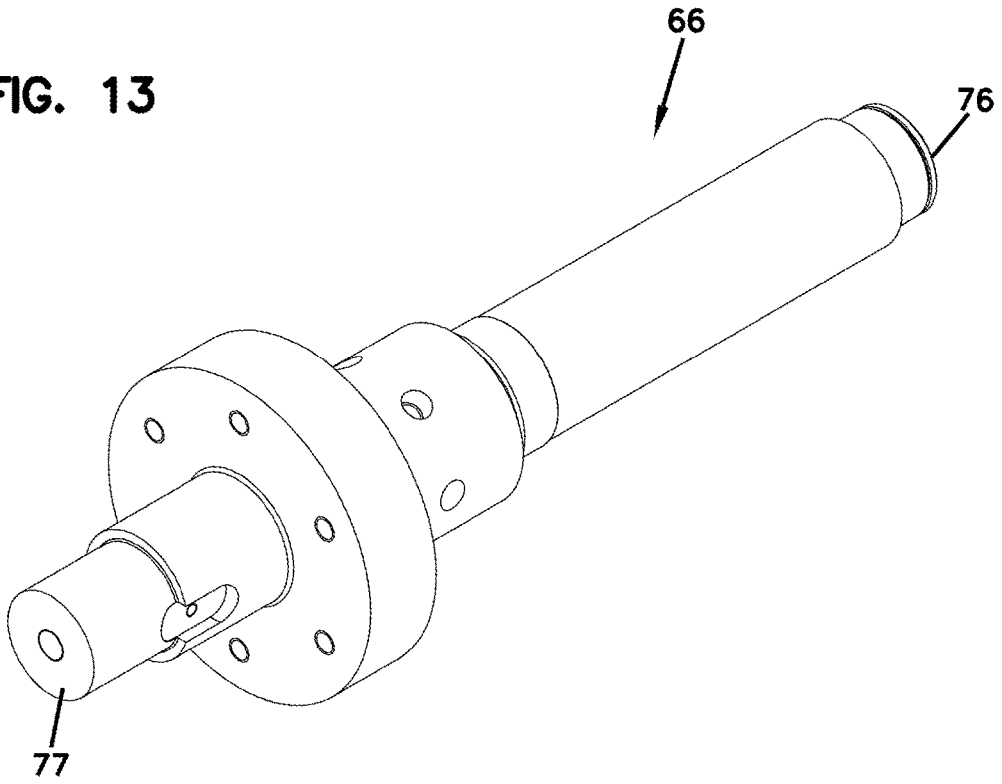
FIG. 13 is a perspective view of a shaft secured to the center of the tool of FIGS. 3 and 4.
Figure 14:
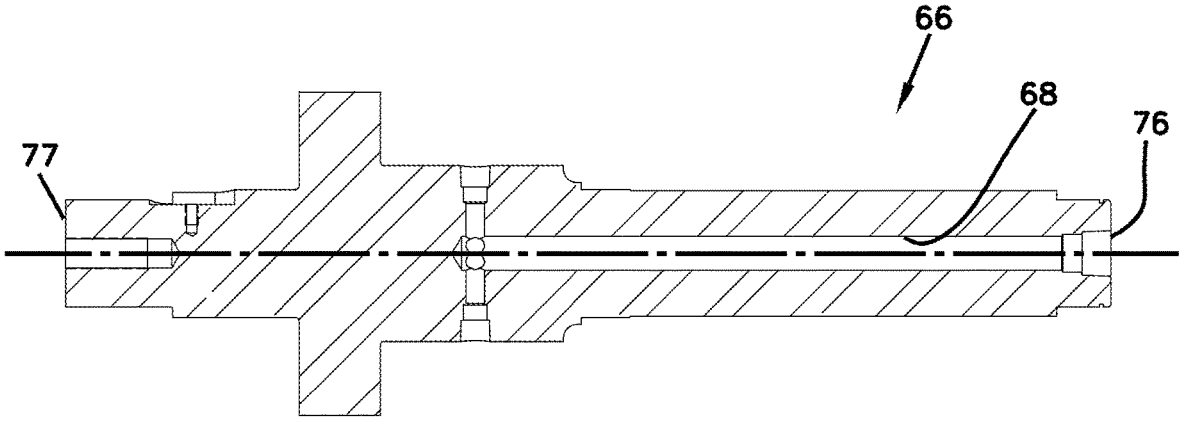
FIG. 14 is a cross-sectional view through the shaft of FIG. 13.

FIGS. 13 and 14 illustrate one embodiment of the shaft 66. In accordance with principles of this disclosure, the shaft 66 includes a fluid passageway 68 (FIG. 14). The fluid passageway 68 will be in communication with the at least one clamp assembly 36. For example, the clamp assembly 36 includes the fluid driven cylinder or cylinder head 54 that is responsive to fluid (air) in the fluid passageway 68 in the shaft 66 to move the clamp pad 38 from the released position to the clamped position. The clamp assembly 35 is preferably pneumatically driven, and the air cylinder head 54 is retractable against the spring 64 responsive to air pressure in the fluid passageway 68 of the shaft 66 to move the clamp pad section 38' in a direction toward the outer disk 34. The end 76 of shaft 66 is in fluid communication with the fluid passageway 68, such that fluid (air) can be provided into a port 69 (FIG. 10) in the end 76.

In reference now to FIG. 5, in accordance with principles of this disclosure, the clamp assembly 35 can include an inner disk 92. The inner disk 92 is secured to the outer disk 34. The inner disk 92 will be on an opposite side of the plate 34 from where the housing 42 of the air cylinder arrangements 36 are located. The inner disk 92 generally has a smaller diameter than the plate 34.

Still in reference to FIG. 5, the inner disk 92 has an outside perimeter 94 with a plurality of outward projections 96. Many embodiments are possible. In the embodiment illustrated, the perimeter 94 of the inner disk 92 has a saw-toothed shape 98. In FIG. 6, it can be seen how the outside perimeter 94 of the inner disk 92 is in axial overlap with the clamp pad section 38'. The combination of the projections 96, the outer disk 34, and the clamp pad section 38' will help to hold the cable in place between and against the clamp pad section 38' and the inner disk 92, when the clamp assembly 35 is in the clamped position and a cable is positioned with a portion between the clamp pad 38 and outer disk 34.

FIG. 8 illustrates an example implementation of a pneumatic system 70 used to control operation of the clamp assembly 35 and the clamp pad section 38'. Fluid, for example air, is directed through the fluid passageway 68 (FIG. 14) of the shaft 66. The fluid or air is then conveyed through pneumatic tubing 72 and to the port 46 (FIG. 12) of the clamp assembly 35.

In many embodiments, the clamp assembly 35 will include two air cylinder arrangements 36, spaced apart from each other. As explained further below, in many embodiments, it is helpful to have at least one and in many cases two linear bearings 82 between the two air cylinder arrangements 36 in each clamp assembly 35.

From a review of FIGS. 4 and 8, it can be appreciated that the at least one clamp assembly 35 includes a plurality of clamp assemblies 35. Each of the clamp assemblies 35 will carry the same reference numbers, as they are generally identical in structure. The plurality of clamp assemblies 35 are mounted along a circumference of the plate 93 and are circumferentially spaced from each other. Each of the clamp assemblies 35 operably controls the respective clamp pad section 38' forming the overall clamp pad 38.

In reference again to FIG. 8, the pneumatic system 70 includes a pneumatic rotary union 74. When air pressure is applied to the end 76 of the shaft 66, the air is conveyed through the fluid passageway 68 and then into the tubing of the pneumatic rotary union 74. When air pressure is applied to the end 76 of the shaft 66, the air cylinder heads 54 retract and move the respective clamp pad section 38' in a direction toward the plate 93. If there is a cable in position, the cable will be clamped by squeezing the cable with the clamp pad section 38'. When air pressure is removed, the springs 64 press against the cylinder heads 54 to move the clamp pad section 38' and unclamp the cable. Many embodiments are possible. If a two-bore shaft is used, air pressure can be applied through one bore to retract the cylinder heads 54 and applied through a second bore to extend the cylinder heads 54. In that example, a twin bore pneumatic rotary union would be used.

In reference now to FIG. 5, the tool 32 may further include a clamp guard 78. As embodied herein, each of the clamp assemblies 35 includes a section of the clamp guard 78. The clamp guard 78 circumscribes and covers an outer rim 80 of the band 40 of the clamp pad 38, including an outer rim of each of the clamp pad sections 38'. The clamp guard 78 can be used to prevent unintended items from getting caught in the clamp assemblies 35.

In accordance with principles of this disclosure, the tool 32 can further include linear bearings 82 mounted to the outer disk 34. The linear bearings 82 help to keep the clamp pad sections 38' at basically the same radial distance from the plate 93 during actuation and release of the clamp assemblies 35. The linear bearings 82 are mounted along the circumference of the plate 93 and between adjacent air cylinder arrangements 36. In FIG. 8, it can be seen how between every pair of air cylinder arrangements 36, there is a pair of linear bearings 82 mounted in between. In the pneumatic rotary union 74 of FIG. 8, each clamp assembly 35 is organized by air cylinder pairs at 84, 85, 86, 87, 88, 89. Each air cylinder pair 84-89 receives air from a single one of the tube 72. In each clamp assembly 35 and between each air cylinder pair 84-89 are two linear bearings 82.

As can be seen in FIG. 8, the plurality of clamp assemblies 35 can be arranged relative to the plate 93 (FIG. 7) to form a sector of a circle shape to the tool 32. Each of the clamp assemblies 35 can be easily removed from the plate 93 for servicing or replacement. For example, each of the outer disks 34 can be fastened to the plate 93 with fasteners.

In reference now to FIG. 2, the spool assembly 28 being used with the tool 34 and winding machine 20 is described. The spool 30 includes a winding cylinder 100. The winding cylinder 100 forms a surface of which cable can be spooled or wound around.

The spool 30 includes a first flange 102. The first flange 102 has an interior surface 104 and an exterior surface 106. The exterior surface 106 of the first flange 102 engages the tool 32. In FIGS. 1 and 2, the tool 32 is shown flat against the exterior surface 106 of the first flange 102.

The spool 30 includes a second flange 108. The second flange 108 has an interior surface 110 and an opposite exterior surface 112.

The flanges 102, 108 are secured to the winding cylinder 100 spaced from and with the respective interior surfaces 104, 110 in opposing relation to each other. The winding cylinder 100 is between the opposing flanges 102, 108 and includes the winding region 114.

At least one of the flanges 102, 108 includes a through-slot 116 (FIGS. 2 and 6). In the embodiment illustrated, the through-slot 116 is shown on the first flange 102. In some embodiments, there can be a through-slot in both the first flange 102 and the second flange 108, the through-slot on the second flange 108 depicted at 116' in FIG. 1. The through-slot 116 allows cable to pass through the first flange 102 from the winding region 114.

The tool 32 is operably connected to the first flange 102. The tool 32 includes at least one clamp assembly 35, preferably a plurality of clamp assemblies 35. The clamp assembly 35 is positioned to receive the cable from the through-slot 116, when a cable is mounted thereon.

When sliding the cable through the slot 116, the operator will push the cable until resistance is felt as the cable engages against one or more of the clamp pad 38, the clamp guard 78, or the piston rod 48 (see FIG. 5). Fluid, such as air, is then applied to the end 76 of the shaft 66, which enters each of the ports 46 and moves the cylinder heads 54 in a direction away from the plate 34. This moves the clamp pad 38 in a direction toward the outer disk 34, the plate 93, and the inner disk 92. The cable will then be squeezed between the clamp pad 38, the inner disk 92, and outer disk 34.

From the above, use of this tool in a method of winding a length of cable onto spool 30 should be apparent. The method includes orienting the end of the cable through the through-slot 116 in the flange 102 of the spool 30. The tool 32 is used to engage a clamp assembly 35 secured to the spool 30 to releasably fix the cable to the tool 32 for winding the cable about the spool.

The step of engaging the clamp assembly 35 includes driving the clamp pad 38 toward the plate 93 of the tool 32 connected to the spool 30.

The step of driving the clamp pad 38 includes pneumatically driving the clamp pad 38 through the fluid passageway 68 of the shaft 66 secured to the plate 93.

The step of pneumatically driving the clamp pad 38 includes driving the cylinder head 54 responsive to the fluid passageway 68 in the shaft 66 to move the clamp pad 38 to squeeze the cable between the clamp pad 38 and the plate 93 or the inner disk 92 or the outer disk 34.

The step of engaging the clamp assembly 35 can include engaging the plurality of clamp assemblies 35 spaced about the flange 102 of the spool 30. The step of engaging the plurality of clamp assemblies 35 includes simultaneously engaging all of the clamp assemblies 35 to move the clamp pad sections 38'. This can be done by actuating the pneumatic rotary union 74.

The method can further include winding the cable about the spool 30. There can further include a step of disengaging the clamp assembly 35 to release the cable from the tool 32.

The step of winding the cable can include using the winding machine 20 to rotate the spool 30 and wind the cable about the winding region 114. After the step of disengaging the clamp assembly 35, there can be a step of removing the spool 30 from the winding machine 20 and the tool 32.

The above represents example principles. Many embodiments can be made according to these principles.

What is claimed is:

1. A tool for a cable winding machine, the tool comprising:

(a) a plate;

(b) at least one clamp assembly mounted to the plate, the at least one clamp assembly including (i) an outer disk with a connection arrangement to allow connection and removal of the clamp assembly from the plate;

(ii) at least one cylinder arrangement secured to the outer disk; and (iii) a clamp pad section operably secured to the cylinder arrangement and being movable toward and away from the outer disk between a clamped position and a released position; and (c) a shaft secured to a center of the plate.

2. The tool of claim 1 wherein the at least one clamp assembly is power-driven.

3. The tool of claim 2 wherein the at least one clamp assembly is one of pneumatically driven or hydraulically driven.

4. The tool of claim 3 wherein:

(a) the shaft includes a fluid passageway in communication with the at least one clamp assembly; and (b) the at least one cylinder arrangement in the clamp assembly includes a fluid driven cylinder responsive to the fluid passageway in the shaft to move the clamp pad section from the released position to the clamped position.

5. The tool of claim 4 wherein:

(a) the at least one clamp assembly is pneumatically driven and the at least one cylinder arrangement in the clamp assembly includes an air cylinder head and a spring; the clamp pad section being secured to the air cylinder head; and (b) the air cylinder head is retractable against the spring responsive to air pressure in the fluid passageway of the shaft to move the clamp pad section in a direction toward the plate.

6. The tool of claim 1 wherein:

(a) the at least one clamp assembly includes a plurality of clamp assemblies mounted to the plate, each of the clamp assemblies includes at least one respective air cylinder head and a spring; the clamp pad section being secured to the respective air cylinder head.

7. The tool of claim 6 wherein:

(a) the plate is circular; and (b) the plurality of clamp assemblies are mounted along a circumference of the plate and are circumferentially spaced from each other, each of the clamp assemblies operably controlling one of the clamp pad sections.

8. The tool of claim 7 wherein each of the clamp assemblies comprises an inner disk secured to the outer disk, the inner disk having an outside perimeter with plurality of outward projections.

9. The tool of claim 8 wherein the outside perimeter of the inner disk has a sawtooth shape, and wherein the outside perimeter of the inner disk is in axial overlap with the clamp pad section.

10. The tool of claim 1 further comprising a clamp guard section covering an outer rim of the outer disk and an outer rim of the clamp pad section.

11. The tool of claim 1 wherein each of the clamp assemblies has at least two air cylinder heads and spring, spaced apart from each other and secured to the outer disk.

12. The tool of claim 11 wherein each of the clamp assemblies further includes two linear bearings mounted between the two air cylinder heads.

13. The tool of claim 1 wherein each of the clamp assemblies further includes at least one linear bearing secured to the outer disk.

14. A spool assembly for holding a length of cable, the spool assembly comprising:

(a) a winding cylinder;

(b) a pair of flanges each having an interior surface and an exterior surface, the pair of flanges being secured to the winding cylinder spaced from and with respective interior surfaces in opposing relation to each other, a region of the winding cylinder between the opposing flanges being a winding region;

(i) at least a first of the flanges including a through-slot sized to allow cable to pass through the first flange from the winding region; and (c) a tool operably connected to the first flange, the tool including a plate and a plurality of clamp assemblies mounted to the plate; each of the clamp assemblies having a power-driven clamp pad movable toward and away from the plate between a clamped position and a released position, the plurality of clamp assemblies being positioned to receive the cable from the through-slot in the first flange, when a cable is mounted thereon.

15. The spool assembly of claim 14 wherein the tool includes a shaft secured to a center of the plate.

16. A method of winding a length of cable onto a spool, the method comprising:

(a) orienting an end of a cable through a through-slot in a flange of a spool; and (b) using a tool and engaging a clamp assembly secured to the spool to releasably fix the cable to the tool for winding the cable about the spool, the clamp assembly including, (i) an outer disk;

(ii) at least one cylinder arrangement secured to the outer disk; and (iii) a clamp pad section operably secured to the cylinder arrangement and movable toward and away from the outer disk between a clamped position and a released position.

17. The method of claim 16 wherein the step of engaging a clamp assembly includes driving the clamp pad section toward a plate of the tool connected to the spool.

18. A clamp assembly for use with a tool for a cable winding machine, the clamp assembly comprising:

(a) an outer disk including a connection arrangement to allow connection and removal of the clamp assembly from a tool for a cable winding machine;

(b) at least one cylinder arrangement secured to the outer disk; and (c) a clamp pad section operably secured to the cylinder arrangement and being movable toward and away from the outer disk between a clamped position and a released position.

19. The clamp assembly of claim 18 wherein the at least one cylinder arrangement includes:

(a) a housing having interior, the housing have a fluid port to permit inflow and outflow from the interior;

(b) a piston rod having a portion within the housing interior and a portion outside of the housing interior;

(c) a cylinder head in the interior secured to the piston rod, the cylinder head positioned to receive fluid flow thereon from the fluid port to move the cylinder head and the piston rod linearly within the housing interior; and (d) a projection secured to the portion of the piston outside of the housing interior, the projection being constructed and arranged to connect to the clamp pad section, the projection moving linearly with the piston rod and cylinder head to move the clamp pad section.

20. The clamp assembly of claim 19 further including a spring in the housing interior biasing the cylinder head.

21. The clamp assembly of claim 19 further including:

(a) an inner disk secured to the outer disk, the inner disk being located on a side of the outer disk opposite of the housing of the cylinder arrangement.

22. The clamp assembly of claim 21 wherein the inner disk has an outside perimeter with plurality of outward projections.

23. The clamp assembly of claim 19 further comprising a clamp guard section covering an outer rim of the outer disk and an outer rim of the clamp pad section.

24. The clamp assembly of claim 19 wherein the at least one cylinder arrangement includes two cylinder arrangements spaced apart from each other and secured to the outer disk.

25. The clamp assembly of claim 19 further comprising at least one linear bearing secured to the outer disk.

26. A tool for a cable winding machine, the tool comprising:

(a) a plate;

(b) a plurality of clamp assemblies mounted to the plate; each of the clamp assemblies including an air cylinder head, a spring, and a clamp pad secured to the respective air cylinder head; each of the clamp pads being movable toward and away from the plate between a clamped position and a released position; and (c) a shaft secured to a center of the plate.

27. The tool of claim 26 wherein:

(a) the plate is circular; and (b) the plurality of clamp assemblies are mounted along a circumference of the plate and are circumferentially spaced from each other, each of the clamp assemblies operably controlling a section of the clamp pad.

28. The tool of claim 27 wherein each of the clamp assemblies comprises:

(a) an outer disk including a connection arrangement to allow connection and removal of the clamp assembly from the plate; and (b) a clamp pad section operably secured to at least one of the air cylinder heads and being movable toward and away from the outer disk between a clamped position and a released position.

29. The tool of claim 28 wherein each of the clamp assemblies comprises an inner disk secured to the outer disk, the inner disk having an outside perimeter with plurality of outward projections.

30. The tool of claim 29 wherein the outside perimeter of the inner disk has a sawtooth shape, and wherein the outside perimeter of the inner disk is in axial overlap with the clamp pad section.

31. The tool of claim 28 further comprising a clamp guard section covering an outer rim of the outer disk and an outer rim of the clamp pad section.

32. The tool of claim 28 wherein each of the clamp assemblies has at least two air cylinder heads and spring, spaced apart from each other and secured to the outer disk.

33. The tool of claim 32 wherein each of the clamp assemblies further includes two linear bearings mounted between the two air cylinder heads.

34. The tool of claim 28 wherein each of the clamp assemblies further includes at least one linear bearing secured to the outer disk.

* * * * *